US006928687B2

(12) United States Patent
Post et al.

(10) Patent No.: US 6,928,687 B2
(45) Date of Patent: Aug. 16, 2005

(54) VEHICLE WINDOW CLEANING APPARATUS AND SYSTEM

(75) Inventors: Kenneth P. Post, Lincoln Park, MI (US); Robert Laskos, Westland, MI (US)

(73) Assignees: K & R Industries, Inc., Lincoln Park, MI (US); part interest; Consumer Solutions, Inc., Houston, TX (US); part interest ( * ) Notice: Subject to any disclaimer, the term of this patent is extended or adjusted under 35 U.S.C. 154(b) by 0 days.

(21) Appl. No.: 10/887,743

(22) Filed: Jul. 9, 2004

(65) Prior Publication Data

US 2004/0237240 A1 Dec. 2, 2004

Related U.S. Application Data

(60) Division of application No. 09/629,721, filed on Jul. 31, 2000, now Pat. No. 6,769,153, which is a continuation-in-part of application No. 09/104,957, filed on Jun. 25, 1998, now Pat. No. 6,178,584.

(51) Int. Cl.[7] ..... A47L 1/06
(52) U.S. Cl. ..... 15/220.1; 15/144.1; 15/232
(58) Field of Search ..... 15/144.1, 144.2, 15/220.1, 228, 231, 232, 244.2, 147.2, 229.6–229.9

(56) References Cited

U.S. PATENT DOCUMENTS

| | | | | |
|---|---|---|---|---|
| 296,235 | A | 4/1884 | Still | |
| 672,584 | A | 4/1901 | Anderson | |
| 825,400 | A | 7/1906 | Lightbown | |
| 869,842 | A * | 10/1907 | Hill | 15/220.1 |
| 1,084,184 | A | 1/1914 | Wenleke | |
| 1,158,846 | A | 2/1915 | Punch | |
| 1,378,243 | A * | 5/1921 | Kracke | 15/220.1 |
| 1,675,736 | A * | 7/1928 | Sturgis | 15/228 |
| 1,989,921 | A | 2/1935 | Goddard | |
| 1,993,571 | A | 3/1935 | Soderberg | |
| 2,127,866 | A | 8/1938 | Plon | |
| 2,192,910 | A | 3/1940 | Hollenbeck | |
| 2,291,435 | A | 7/1942 | Anderson et al | |
| 2,301,586 | A | 11/1942 | Rubin | |
| 2,304,127 | A | 12/1942 | Stetson | |
| 2,315,325 | A | 3/1943 | Gavurin | |
| 2,560,008 | A | 7/1951 | Steward | |
| 2,694,212 | A | 11/1954 | McGraw | |
| 2,722,704 | A * | 11/1955 | Warden | 15/153 |
| 2,764,774 | A | 10/1956 | Belsky et al. | |
| 3,362,037 | A | 1/1968 | Griffin | |
| 3,761,991 | A | 10/1973 | Moss | |
| 4,503,579 | A | 3/1985 | Nicely | |
| 4,926,522 | A | 5/1990 | Wang | |
| 5,003,659 | A | 4/1991 | Paepke | |
| 5,012,544 | A | 5/1991 | Verry | |
| 5,095,574 | A | 3/1992 | Khanzadian | |
| 5,333,347 | A | 8/1994 | Stranders | |
| 5,596,787 | A | 1/1997 | Steven et al. | |
| 5,603,138 | A | 2/1997 | Bonis | |
| 5,657,507 | A | 8/1997 | Wasak | |
| 5,918,342 | A | 7/1999 | Smith et al. | |
| 6,178,584 | B1 | 1/2001 | Post | |
| 6,523,213 | B1 | 2/2003 | Post | |
| 6,769,153 | B1 | 8/2004 | Post et al. | |
| 6,795,999 | B1 | 9/2004 | Post et al. | |

FOREIGN PATENT DOCUMENTS

| | | |
|---|---|---|
| FR | 1056318 | 10/1953 |
| GB | 406211 | 2/1934 |

* cited by examiner

*Primary Examiner*—Mark Spisich
(74) *Attorney, Agent, or Firm*—Young & Basile, P.C.

(57) ABSTRACT

A cleaning apparatus and system includes at least one handle, at least one paddle, and at least one cleaning element. The handle is a pivotally attachable to each paddle. The cleaning element has elastic to draw the side edges of the body inward to form an opening smaller than the outer diameter of the paddle to releasably attach the cleaning element about the paddle. A receiver is mounted on each paddle and movably receives one end of the handle.

5 Claims, 8 Drawing Sheets

VEHICLE WINDOW CLEANING APPARATUS AND SYSTEM

CROSS REFERENCE TO CO-PENDING APPLICATION

This application is a division of U.S. patent application Ser. No. 09/629,721, filed Jul. 31, 2000, now U.S. Pat. No. 6,169,153 issued Aug. 30, 2004, which is a continuation-in-part of application Ser. No. 09/104,957, filed on Jun. 25, 1998, now U.S. Pat. No. 6,178,584, issued Jan. 30, 2001, the entire contents of which are incorporated herein by reference.

BACKGROUND

1. Field of the Invention

The present invention relates, in general, to cleaning apparatus and more specifically, to apparatus for cleaning vehicle windows.

2. Description of the Art

Various tools are available to clean the exterior surface of vehicle windows. Such tools typically include a handle and a perpendicularly oriented cleaning element, such as a wiper blade, sponge rubber pad and combinations thereof. Water or ammonia based cleaning fluid is applied to the exterior surface of the vehicle window and scraped off by the tools to remove debris. Such tools are easy to use on the exterior surface of vehicle windows since the exterior surface of the vehicle windows is easily accessible both to apply cleaning fluid to the windows and to remove the fluid and debris from the windows.

However, such tools are ineffective in cleaning the inner surface of vehicle windows. The extreme angles of the vehicle windshield and backlight with respect to the dashboard and rear seat shelf in conjunction with adjacent vehicle components, such as the rear view mirror, steering wheel and rear, center brake light housing make it difficult to get the edges of a cleaning tool close to the extreme lower edges of the windshield and backlight. In addition, applying fluid, which is typically in the form of a spray, to the inner surfaces of the windshield and backlight results in a significant amount of the spray being deposited on the underlying horizontal surfaces adjacent to the windows, such as the vehicle dashboard and the rear shelf.

Thus, the most common implements used to clean the inner surfaces of vehicle windows are sponges, rags and paper towels. Manual force is exerted through the user's hands to manually apply cleaning fluid and/or spray to the inner surface of the windows and then to manipulate the cleaning element in a back and forth or circular motion across the surface of the windows. While a user may be able with a considerable amount of effort to clean most of the inner surface of the vehicle window, it is still difficult to completely clean the edges of the window and, more importantly, the lower edges of a vehicle windshield and backlight.

A variety of tools have been devised specifically to clean the inner surfaces of vehicle windows. Such tools are typically formed of a pad which is connected to an elongated handle. A cleaning element is attached to one side of the pad by various means including clips, straps, or hook and pile fasteners. However, each of these tools is specifically devised for a single type of cleaning operation, such as scrubbing or drying, but not both.

While such tools improve the reach of the user, it is believed that further improvements can be made to make the cleaning apparatus easier to use, to provide easily detachable and interchangeable mounting of different shaped pads to the handle, as well as to provide easy replacement of wet, soiled cleaning elements. It is also believed that such cleaning apparatus can be improved by providing a system approach in which multiple, different cleaning elements for scrubbing, washing and drying windows or other surfaces are interchangeably mountable on a single handle, or preferably, a plurality of different shaped handles thereby adapting the cleaning system of the present invention to many different applications.

SUMMARY

The present invention is a cleaning apparatus suited for cleaning and drying various surfaces, such as the interior and exterior surfaces of vehicle windows.

In one aspect, the cleaning apparatus includes a substantially rigid paddle having first and second opposed surfaces. A handle is pivotally connected on one end to the first surface of the paddle. A cleaning element is removably affixed to the paddle. The cleaning element includes a first surface mountable in registry with the second surface of the paddle and side edges disposed over a peripheral portion of the paddle. Elastic means are provided on the side edges of the cleaning element for elastically securing the cleaning element about the paddle.

Preferably, the cleaning element forms part of a cleaning system which includes at least two distinct cleaning elements, one a washing or scrubbing element and, another, a drying body formed of an absorbent material. The ends of the side edges of the cleaning element are drawn inward by the elastic means to form an opening normally smaller than the periphery of the paddle. Pivot means are cooperatively formed on the first surface of the paddle and the one end of the handle for pivotally connecting the paddle to the handle.

In one aspect, pivot means includes first and second pivot pins extending coaxially outward from opposed sides of one end of the handle. First and second receivers are mounted on the paddle for receiving the first and second pivot pins, respectively.

In another aspect of the present invention, the above-described cleaning apparatus forms part of a cleaning system which includes a first handle, a plurality of cleaning elements of the same or different shape, and a plurality of paddles, at least some of which have a different peripheral shape. The cleaning elements are easily mountable on any of the paddles to enable a clean and dry cleaning element to be used whenever needed. In addition, each of the paddles is quickly and easily attachable and detachable from the handle for ease in using the cleaning system of the present invention.

In yet another aspect, the cleaning apparatus and cleaning system of the present invention includes a second handle having a generally inverted U-shape with opposed lower ends extending oppositely outward from each other. The handle ends are releasably mountable in a second pair of receivers formed on each paddle. The paddles receive cleaning elements as in the above-described aspects of the invention.

Generally, the second handle is of one-piece construction with lower S-shaped side legs extending between an upper hand engagement portion and the ends. The S-shape side legs are is configured to absorb forces exerted by the user on the handle during movement of the paddle. The second set receivers may also be formed on the same paddles in the first aspect of the invention. This enables either the first or second handles to be employed with any paddle thereby further enhancing the interchangeability of the various components of the cleaning system of the present invention.

In another aspect, a single receiver is mounted generally along the longitudinal center line axis of the paddle. The receiver has a first open end extending through the paddle. The first open end has a first diameter sized to slidably receive a ball mounted on the end of an elongated handle or handle connector. The other second end of the receiver has a smaller opening sized to trap the ball in the receiver. A plug having a ball shaped seat is slidable through the first open end of the receiver and locked in place to trap the ball and handle or handle connector in the receiver. In one aspect, slots extend from the second end of the receiver to allow rotation of the ball and the handle or handle connector along only one axis.

In another aspect, a U-shaped receiver is mounted transversely on the paddle and has a slot-like opening of a first spacing slightly less than the diameter of an end portion of the handle to allow the end portion of the handle to snap through the smaller end into a larger diameter portion of the receiver wherein the handle is rotatable in the receiver; but is held in the receiver by the smaller opening of the receiver.

In another aspect, the pivot means includes two legs formed on the paddle, each having an aperture formed therein. A U-shaped, resilient member has outward turned ends which act as pivot pins when mounted in the apertures through legs on the paddle. The central portion of the U-shaped member has a nominal width wider than the interior diameter of a bore extending from a first end of the handle to enable the U-shaped member to be press fit within the open end of the handle to pivotally connect the handle to the paddle.

In yet another aspect, the receiver has a magnetic latch which holds a pivotal flap in the closed position rotatably trapping a rod-like end portion of the handle in the receiver. The flap may be easily moved to the open position to allow the handle to be disengaged.

The cleaning apparatus from the receiver and cleaning system of the present invention affords numerous advantages over prior cleaning apparatus devised for cleaning various surfaces, such as the interior and exterior surfaces of vehicle windows. The present cleaning system enables a plurality of different shaped paddles and attached washing, scrubbing and drying elements to be detachably mounted on a handle for use in practically any surface cleaning application, such as vehicle windows. The cleaning apparatus lends itself to use as part of a cleaning system formed of one or more handles, a plurality of different shaped paddles, and releasably attachable cleaning elements. The cleaning elements are easily mountable and removable from the paddles and the paddles are easily attachable and detachable to any of the handles. The present cleaning apparatus enables a user, for example, to easily reach the lower edges of the interior surface of vehicle windows adjacent to the vehicle dash board or rear backlight despite the extreme angles of such windows with respect to interior vehicle surfaces and the adjacent rear view mirror, steering wheel or rear center brake light assembly housing.

BRIEF DESCRIPTION OF THE DRAWING

The various features, advantages and other uses of the present invention will become more apparent by referring to the following detailed description and drawing in which.

DETAILED DESCRIPTION

Figure 1:
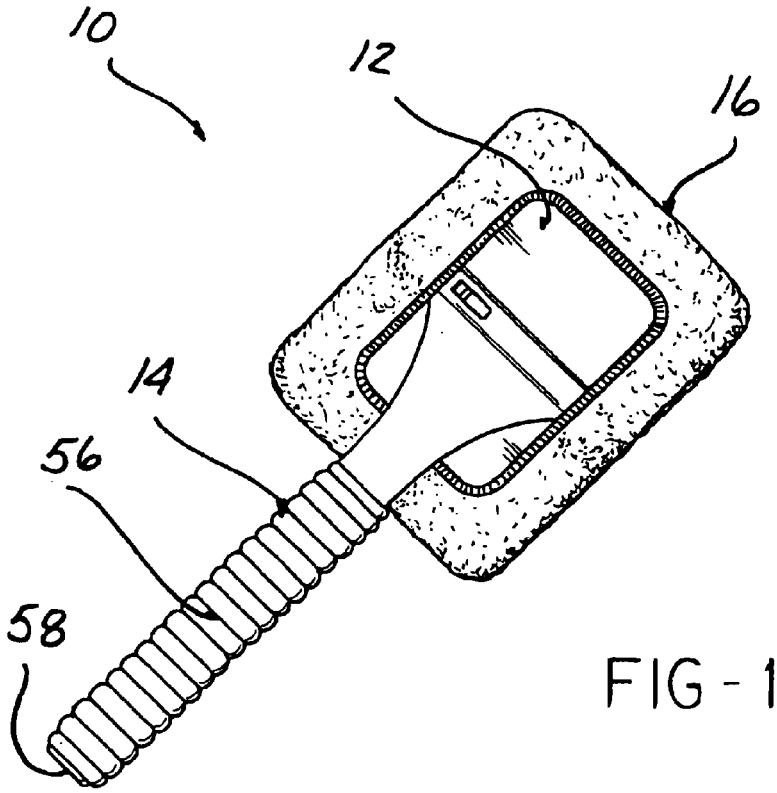
FIG. 1 is an assembled, perspective view of a first aspect of a cleaning apparatus according to the present invention with a drying element mounted thereon.

Referring now to the drawing, and to FIGS. 1–5 in particular, there is depicted a first aspect of a cleaning apparatus 10 constructed in accordance with the teachings of the present invention. It will be understood that although the following description of the use of the cleaning apparatus 10 in cleaning and drying the interior surfaces of vehicle windows, the cleaning apparatus 10 may also be applied in a variety of other cleaning applications, such as to clean and dry the exterior surface of the vehicle windows, house or building windows, mirrors, or practically any surface that requires the use of a cleaning fluid and its removable from the surface being cleaned.

In general, the cleaning apparatus 10, includes a paddle 12, a handle 14, and a drying element 16.

As shown in one aspect in FIGS. 1–4, the paddle 12 is formed of a generally planar plate 20 having one of a number of different configurations or sizes. The plate 20 is preferably formed of a lightweight material, with a suitable plastic material being preferred. However, other materials, such as metal, wood, composites, etc., may also be employed.

The plate 20 has a generally rectangular or possibly square configuration with four exterior side edges each denoted by reference number 22. Rounded corners or radii are formed at the juncture of each of two side edges 22.

The plate 20 is also formed with a first or rear surface 50 and a second, opposed, front surface 52.

The plate 20 may be provided in two different sizes, such as a small size and a large size. By example only, a small size plate 20 may have dimensions of 5"×7". The larger plate 20 may have dimensions of 7"×9". It will be understood that the plate 20 may also be formed with a square configuration of equal length side edges 22 and with other square or rectangular dimensions as needed for a particular cleaning application.

Figure 5:
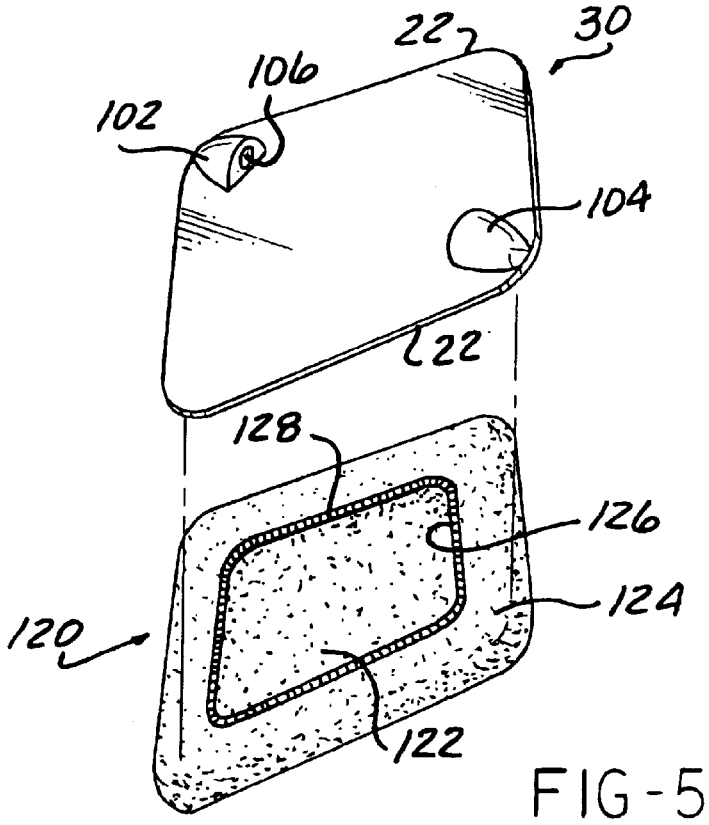
FIG. 5 is a perspective view of a second aspect of a drying element and paddle.

The paddle 12 may also be formed in other configurations for drying different shaped windows or portions of a vehicle window. As shown in FIG. 5, a plate 30 has a general oval shape with maximum dimensions of 7"×9" for a large oval shaped plate 30 or 5"×7" for a smaller oval shaped plate 30. All of the exterior surface or side edges of the paddle 30 is smoothly curved without any sharp projections or corners.

Figure 6B:
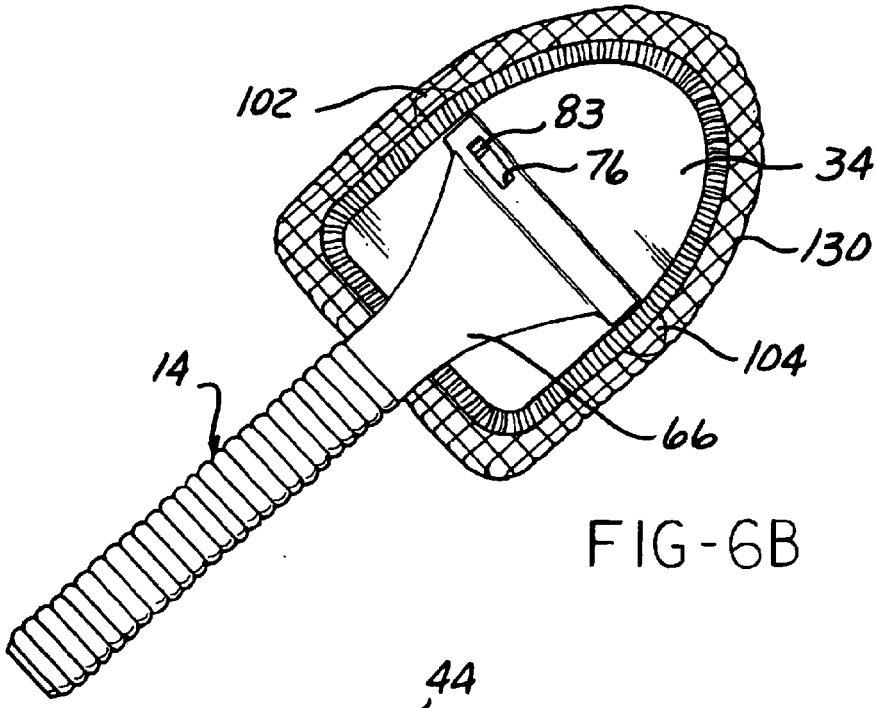
FIG. 6B is a perspective view of the assembled cleaning apparatus of FIG. 6A with the scrubbing element mounted thereon.
Figure 6A:
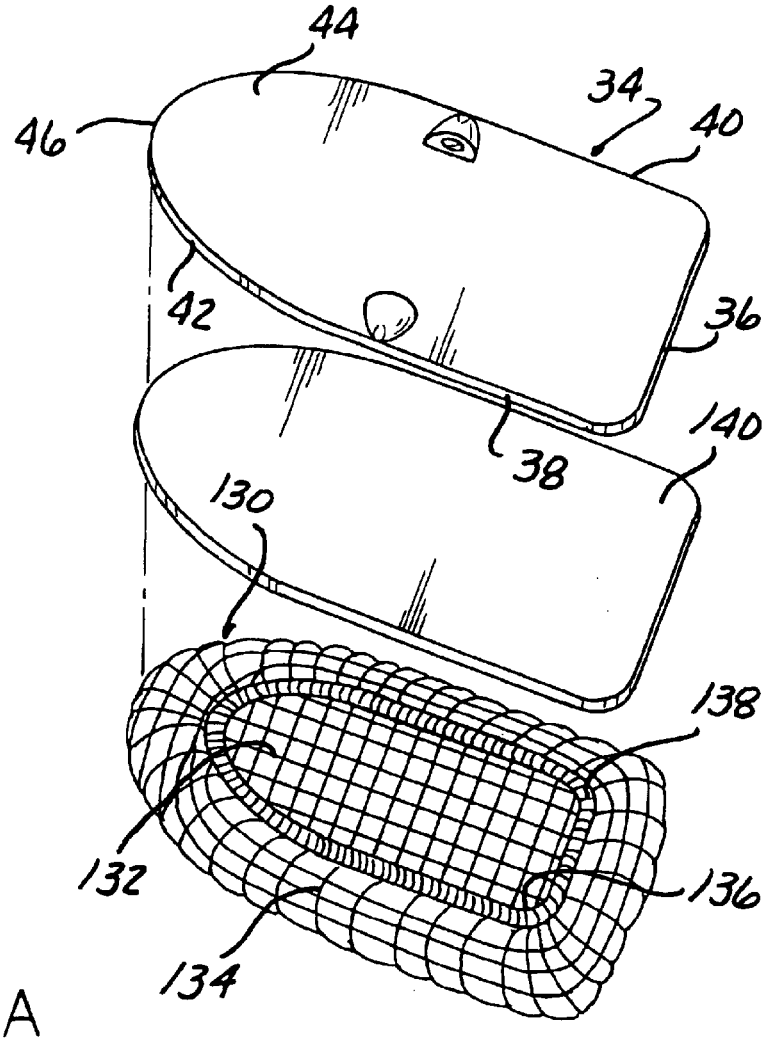
FIG. 6A is an exploded perspective view of a scrubbing element and paddle.

FIGS. 6A and 6B depict a plate 34 which may also be used to form the paddle 12 of a cleaning aspect of the apparatus 10. In this aspect, the plate 30 has a first flat side edge 36 which smoothly merges into two generally perpendicularly extending side edges 38 and 40. The side edges 38 and 40 have an end portion 42 and 44, respectively, which tapers inwardly toward each other thereby narrowing the width of the plate 34 at a second end 46 opposite from the side edge 36. The tapered portions 42 and 44 extend to a smoothly rounded apex or second end 46.

Figure 2:
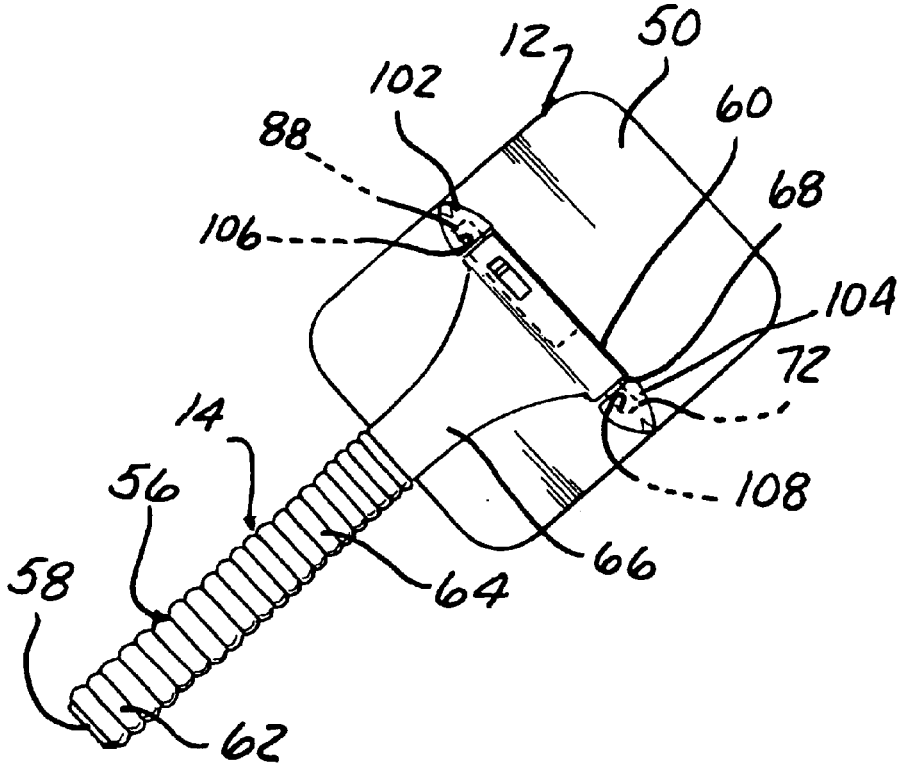
FIG. 2 is a perspective view of the handle and paddle of the cleaning apparatus shown in FIG. 1.

As shown in FIGS. 1 and 2, the paddle 12, regardless of its plate configuration 20, 30 or 34, may have a generally planar shape. A slight concave bend may also be formed in any of these plate 20, 30 or 34.

Referring now to FIGS. 1–3, the handle 14 of the cleaning apparatus 10 may take one of a variety of different shapes to provide a convenient gripping surface even when wet. Thus, by example, the handle 14, shown in FIGS. 1 and 2, is formed of a lightweight material, such as a somewhat rigid, although flexible and slightly bendable plastic. The handle 14 is formed of an elongated member 56 of one of at least two distinct lengths and having a first end 58 and an opposed second end 60. The elongated member 56 extends generally planarly between the first and second ends 58 and 60. Although the member 56 may have a constant cross-section and a constant width dimension from end to end, in order to provide a more easily grippable surface 14, the member 56 is formed with a first enlargement 62 at the first end 58. The opposed side edges of the member 56 taper inwardly from the first enlargement 62 to a smaller width intermediate portion 64 before tapering outwardly to a second enlarged portion 66 adjacent the second end. At least a portion of the first enlargement 62 and the intermediate portion 64 of the member 56 may be formed with a rough or contoured exterior surface, such as a series of serrated, spaced ridges or projections as shown in FIGS. 1 and 2, to provide an easily grippable surface even when wet.

As shown in FIGS. 2 and 3, the side edges of the second enlarged portion 66 taper smoothly outward from the intermediate portion 64 and terminate in opposed first and second side edges 68 and 70, adjacent the second end 60 of the member 56.

The cleaning apparatus 10 also includes means for mounting any of the plates 20, 30 and 34, one at a time, to the handle 14. Preferably, the mounting means includes means for detachably mounting the plates 20, 30 and 34 to the handle 14. More preferably, means are provided for pivotally and detachably mounting the plates 20, 30 and 34 to the handle 14.

Figure 3A:
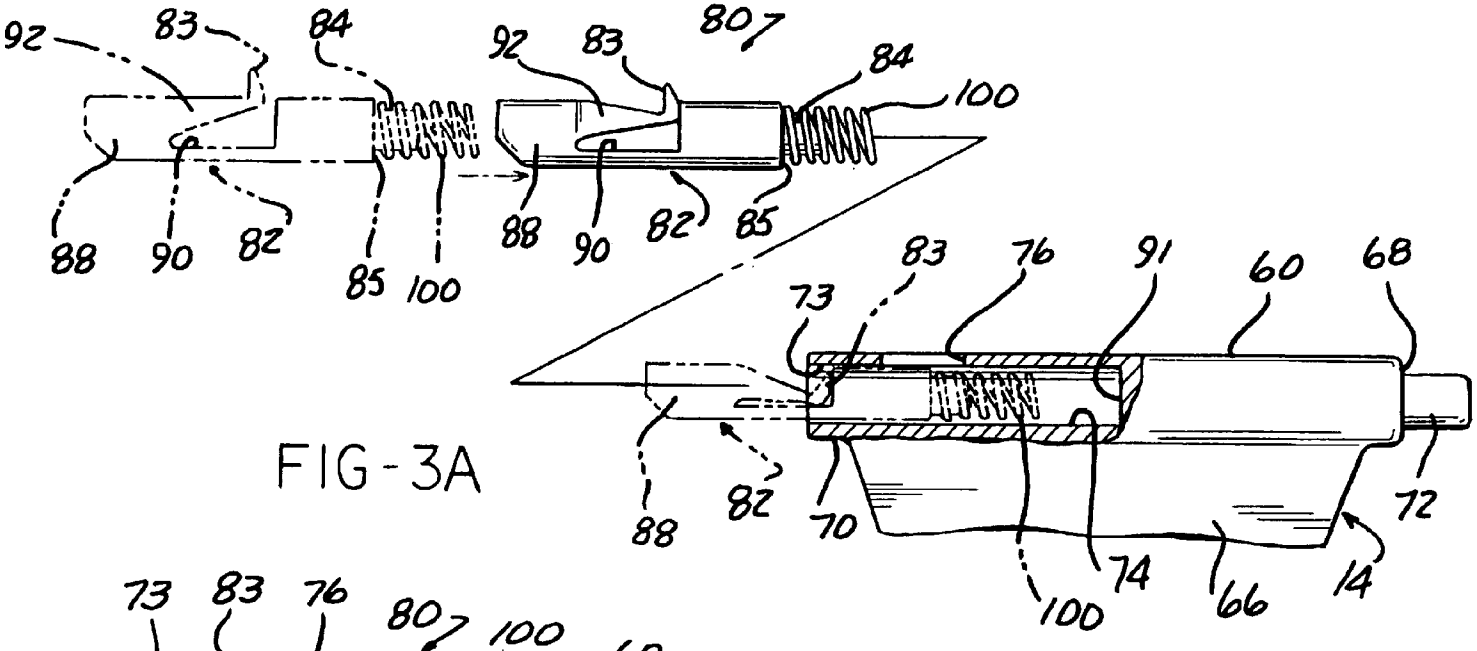
FIG. 3A is a sequential representation of the insertion of the spring biased pin into the handle shown in FIGS. 1 and 2.
Figure 3B:
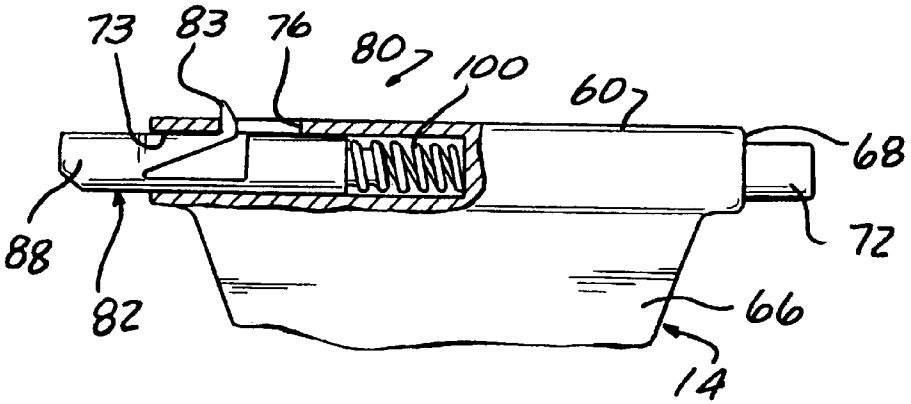
FIG. 3B is a partially broken-away, plan view of the spring biased pin in its assembled position in the handle.

According to one aspect of the present invention shown more clearly in FIGS. 3A and 3B, the mounting means includes a pivot pin 72 mounted or unitarily formed on the first side edge 68 of the member 56. A notch 75 is formed in the pivot pin 72 to facilitate mounting of the pivot pin 72 in a receiver, as described hereafter. The opposite or second side edge 70 is formed with an aperture 73 which opens to an interior chamber 74 in the second enlarged portion 66 of the member 56 adjacent to the second end 60. An opening or cut out 76 in the exterior surface of the handle 14 communicates with the interior chamber 74.

A spring biased pin assembly 80 includes a slider 82 having a generally cylindrical cross section. The slider 82 is formed with a reduced diameter first end in the form of a circular sleeve 84. A shoulder 85 on the slider 82 form a seat for a biasing spring, such as a coil spring 100 which also engages one end of the interior chamber 74.

The opposed end of the slider 82 is formed as a pivot pin 88 having essentially the same shape as the pin 72 mounted on the side edge 68 of the handle 14. A notch or recess 90 is formed in the slider 82 adjacent to the pin 88 at one end of the slider 82. The recess 90 forms a resilient, movable arm 92 along one side of the slider 82. The free end of the arm 92 is formed in a projection or catch 83 which extends beyond the exterior surface of the adjacent portion of the slider 82 in a normal, biased position shown in FIG. 3A.

In assembling and mounting the spring biased pin assembly 80 as shown in FIGS. 3A and 3B, the spring 100 is mounted over the sleeve 84 on the slider 82. The spring biased pin assembly 80 is inserted spring first through the aperture 73 into interior chamber 74 in the handle member 56.

The arm 92 is depressed by the user toward the opposite side of the slider 82 to enable the outer end of the projection or catch 83 to be inserted through the aperture 73 in the handle 14. The end of the catch 83 is angled to aid in downward movement of the catch 83 upon engagement with the end 70.

Continued insertion forces are exerted on the end of the pin 88 of the slider 82 until the projection 83 passes the interior edge of the opening 76 in the enlarged end portion 66 of the handle 14. The resilient nature of the arm 92 enables the projection 83 to snap outward, as shown in FIG. 3B, to lock the spring biased pin assembly 80 within the interior chamber 74 of the handle 14 as shown in FIG. 3B. The spring 100 is compressed a slight amount to exert a spring force against the slider 82 to maintain the slider 82 in a position in which the projection 83 normally engages one edge of the opening 76 in the handle 14.

As shown in FIGS. 1 and 2, the pins 72 and 88 are co-axially aligned and form part of hinge means which are rotatably mountable in opposed hinge members 102 and 104 as shown in FIG. 1. Each of the hinge members or receivers 102 and 104 are preferably unitarily formed as part of the first or rear surface 50 of the paddle 12. Since the paddle 12 is preferably formed of a plastic, the hinge members 102 and 104 may be unitarily molded as part of the paddle 12.

Figure 4:
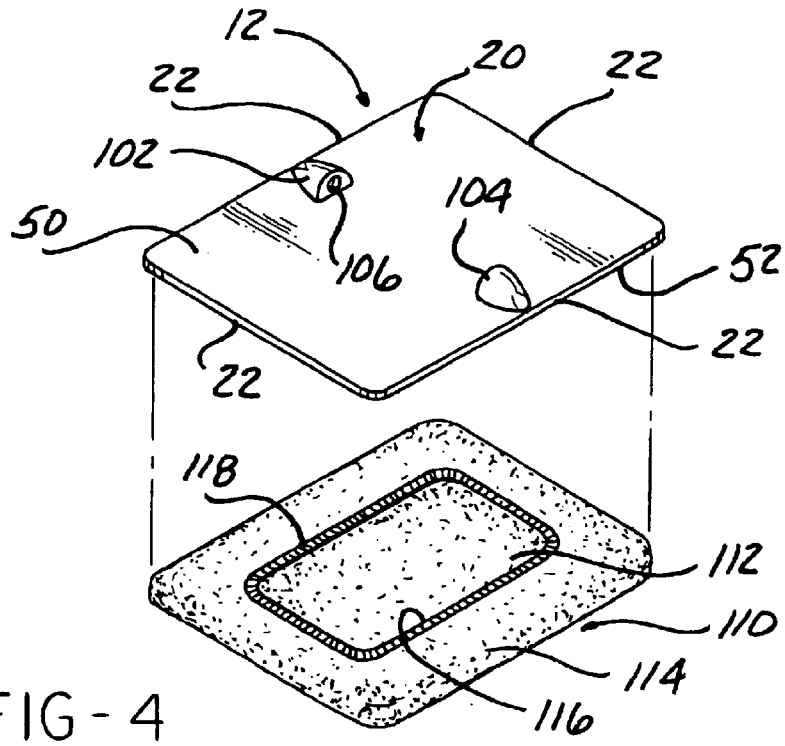
FIG. 4 is a perspective view of a first aspect of a drying element and paddle.

Each of the hinge members 102 and 104 are in the form of solid bodies which are unitarily formed as part of the plate 20 and project upwardly from the first rear surface 50 of the plate 20. As shown in FIGS. 4 and 5, each of the hinge members 102 and 104 is formed with an inner face opposing the inner face of the opposed hinge member in a smoothly curved or arcuate shaped outer surface extending toward the adjacent side edge 22. Alternately, the hinge members 102 and 104 may be simple flanges projecting perpendicularly from the first rear surface 50 of the plate 20, with each flange having an aperture for receiving the pivot pins 72 and 88.

Thus, the internal bores 106 and 108, respectively, receive the pivot pins 88 and 72, respectively, on the handle 14 to pivotally couple the plates 20, 30 and 34 to the handle 14 and enable substantially 180° pivotal movement of the handle 14 relative to the plates 20, 30 and 34.

Each plate embodiment of the paddle 12 is coupled to the handle 14 by pushing the projection 83 on the slider 82 away from the adjacent side edge 70 of the handle member 56 to retract the end 88 of the slider 82 inwardly within the interior chamber 74 in the second enlarged portion 66 of the handle member 56 to enable the second side edge 70 to be disposed adjacent to the inner surface of the second hinge member 102, it being understood that the opposed pivot pin 72 has already been inserted into the bore 108 in the second hinge member 104. Release of the projection 83 allows the spring 100 to move the slider 82 away from the spring stop 91 and to urge the second pivot pin 88 outwardly through the aperture 73 in the second side edge 70 of the handle member 56 and into the bore 106 in the hinge member 102.

The projection or catch 83 is positioned along the length of the slider 82 from the second pivot pin end 88 to enable the pivot pin 88 to be completely retracted within the second end 60 of the handle 14 when the projection 83 engages the far end of the opening 76. Release of the moving force on the projection 83 enables the spring 100 to move the slider 82 in an opposite direction until an opposite edge of the projection 83 engages the edge of the opening 76 and the pivot pin 88 projects exteriorly of the second end 60 of the handle 14.

A first drying element embodiment of the cleaning element 16 which is removably mountable on the paddle 12 is shown in FIG. 4. In this embodiment, the drying element is in the form of a pliable body 110 sized to releasably mount about the plate 20 of the first embodiment of the paddle 12. Thus, the body 110 has a first major surface 112 which is disposable adjacent a second front surface 52 of the plate 20, a continuous side edge 114 extending from the first major surface 112, and a peripheral edge 116 surrounding an open end opposite the first surface 112. The peripheral edge 116 may be stitched to prevent unraveling or separation of the fibers forming in the body 110. Preferably, the body 110 is formed of an absorbent material, such as cotton, etc.

Elastic means 118 in the form of an elastic band is stitched or otherwise attached to the peripheral edge 116 of the body 110 to provide an elastic force for closing the peripheral edge 116 to a small open diameter to thereby securely, yet releasably mount the body 110 about the paddle 12. At the same time, the elastic means 118 allows the body 110 to be easily removed from the paddle 12 and replaced with a clean, dry body 110 when necessary.

It will be understood that the body 110 may be provided in different sizes to conform to the shape and size of the large or small plates 20 described above.

A second aspect of a body 120 usable as the drying element is shown in FIG. 5 and includes a first major surface 122, a continuous side edge 124 and a peripheral edge 126. Elastic means 128 are secured to the peripheral edge 126. Preferably, the peripheral edge 126 and the adjacent side edge 124 are formed or cut to a generally oval shape to enable the body 120 to conform to the shape of the oval plate 30.

Yet another body 130, shown in FIGS. 6A and 6B, may be used as the cleaning element 16 for the plate 34. Like the other bodies 110 and 120, the body 130 is formed of a first, generally planar surface 132, a side edge 134 which terminates in continuous peripheral edge 136 surrounding an opening, and elastic means 138 secured to the peripheral edge 136. The peripheral edge 136 and the side edge 134 are preferably formed in the shape of the plate 34 to enable the body 130 to be removably mounted about and to conform to the shape of the plate 34. As shown in FIG. 6A, an absorbent layer or pad 140 of substantially the same shape as the plate 34 is interposed between a major surface of the plate 34 and the first major surface 132 of the body 130 to provide fluid absorbent features. The pad 140 can be loosely interposed between the plate 34 and the body 130 or fixed on the plate 34 by adhesive or other suitable means. The body 130, in this embodiment, is preferably formed of a mesh or rough material to act as a scrubbing surface in conjunction with a fluid filled absorbent layer 140 which dispenses fluid during the scrubbing operation. Thus, the body 130 and absorbent layer 140 function as a scrubbing element to apply cleaning fluid to a window and, with suitable scrubbing movement, to simultaneously loosen dirt and other debris from the window.

Figure 6C:
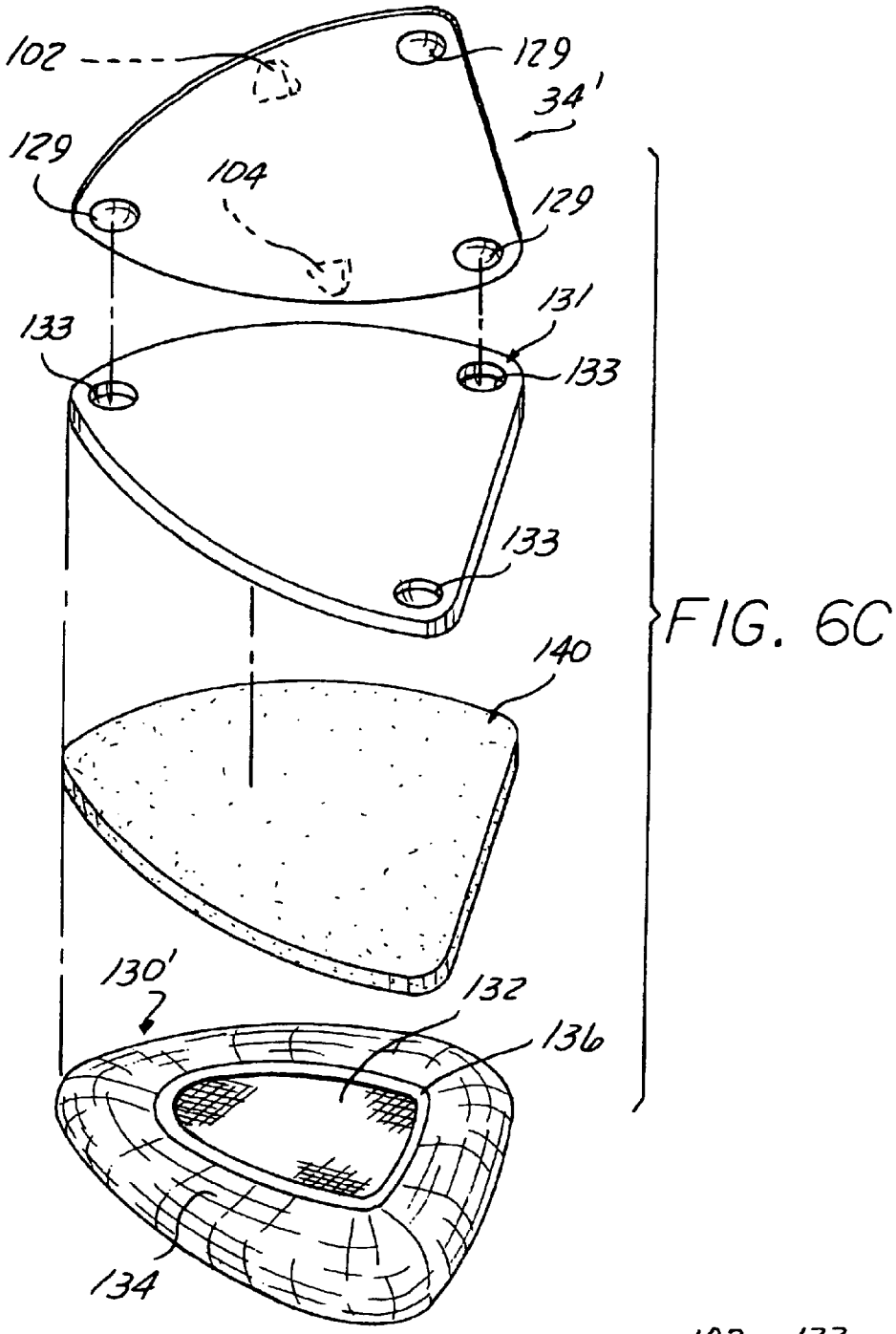
FIGS. 6C and 6D are perspective views similar to FIGS. 6A and 6B, respectively, and showing a modification to the scrubbing element depicted in FIGS. 6A and 6B.
Figure 6D:
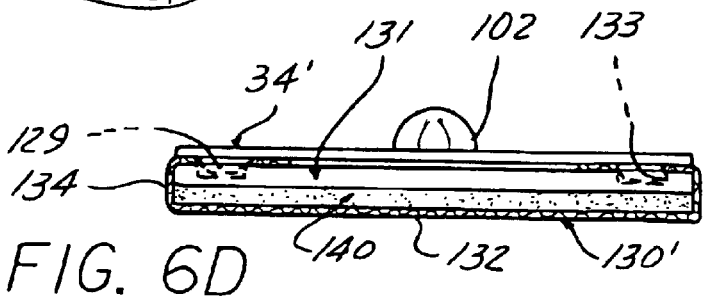

FIGS. 6C and 6D depict a modification to the cleaning element shown in FIGS. 6A and 6B. In this aspect of the invention, the plate 34' has a more triangular shape than the plate 34 shown in FIG. 6A, and a narrower apex, more pointed to enable the apex end of the cleaning element to be more easily slid into tight corners, such as the bottom edge or bottom corner of a steeply angled vehicle windshield.

The plate 34' includes a plurality, such as three by example only, of sacrificial material projections 129 which are integrally formed with the plate 34' and located generally near the corners of the plat 34'. A backer plate 131 having the same peripheral shape as the plate 34' is provided with three mating recesses or apertures 133 arranged in positions on the backer plate 131 for mating engagement with the projections 129 on the plate 34', as described in greater detail hereafter.

A pad 140, typically in the form of an absorbent material, such as sponge rubber, is loosely or adhesively fixed to one surface of the backer plate 131. Preferably, the pad 140 is a self-adhesive sponge. The body 130' also having the more triangular shape of the plate 34' and constructed identically to the body 130 shown in FIG. 6A, is elastically mounted about the backer plate 131 trapping the absorbent layer or pad 140 therebetween. The backer plate 131 is then mated with the plate 34' bringing the projections 129 into engagement with the recesses 133 in the backer plate 131. Ultrasonic heating is applied to the two plates 34' and 131 to cause localized melting of the projections 129 in the recesses 133 and a fixed, integral attachment of the backer plate 131 to the plate 34'. It should be noted that portions of the body 130' are trapped between the projections 129 mating recess 133. Alternately, the body 130' may be disposed about the backer plate 131, the pad 140 and the plate 34' after the plate 34' is welded to the backer plate 131.

The various drying and cleaning bodies 110, 120 and 130 shown in FIGS. 4–6 may be used to perform a variety of cleaning or drying tasks. Any of the bodies 110 and 120 may be used merely as a dusting cloth to remove dust from a vehicle window or other interior vehicle surface. Further, the body 130 shown in FIG. 6A and its associated plate 34 with the rounded end 46 and interior absorbent layer 140 is ideally suited to act as a sponge and scrubbing surface in applying cleaning fluid or water to the interior surface of a vehicle window and scrubbing or removing debris stuck on a window.

Once the absorbent layer 140 is wetted with the cleaning fluid, the handle 14 of the cleaning apparatus 10 is grasped by one hand of the user and then moved adjacent to the window until the body 130, contacts the interior surface of the window. The cleaning element 10 is then moved in any motion, such as back and forth, sideways, circular or combinations thereof to apply the cleaning fluid to the entire interior surface of the window and to remove any debris stuck on the window. The body 130 and plate 34 are then removed from the handle 14 by simply reversing the insertion operation of the spring biased pin assembly 80 as described above to detach the plate 34 and the from the handle 14. Specifically, the user exerts a sliding force on the projection 83 to the right, in the orientation shown in FIG. 3B, urging the slider 82 against the force of the spring 100 until the pin 88 on the slider 82 disengages from the associated hinge 102. This enables the paddle 12 and the handle 14 to be separated from each other. One of the other bodies 110 or 120 and its associated plate 20 or 30, respectively, is then attached to the handle 14 as described above. The body 110 or 120 is then brought into engagement with the window and again moved in any fashion across the entire surface of the window to dry the previously applied cleaning fluid and remove any loose debris from the window.

If, at any time, the body 110 or 120 becomes saturated with cleaning fluid or accumulates a significant amount of dirt or other debris, the user may simply remove the body 110 or 120 from the associated paddle 12 and then mount a clean, dry body 110 or 120 on the paddle 12 to continue with the cleaning operation.

In a further use of the cleaning apparatus described above, any of the paddles, such as paddle 34 shown in FIG. 6A, can be employed without the handle 14 by a user merely grasp the enlarged receivers 102 and 104 with his or her hand to manipulate the paddle and the cleaning element attached thereto over a surface to be cleaned.

Figure 7:
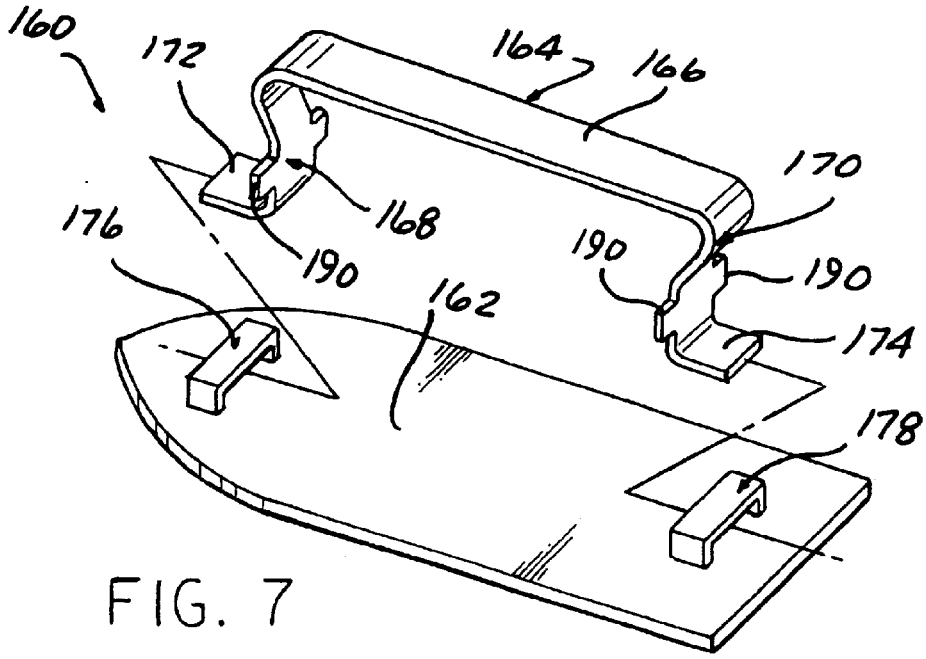
FIG. 7 is an exploded perspective view of another aspect of the present cleaning apparatus.
Figure 8:
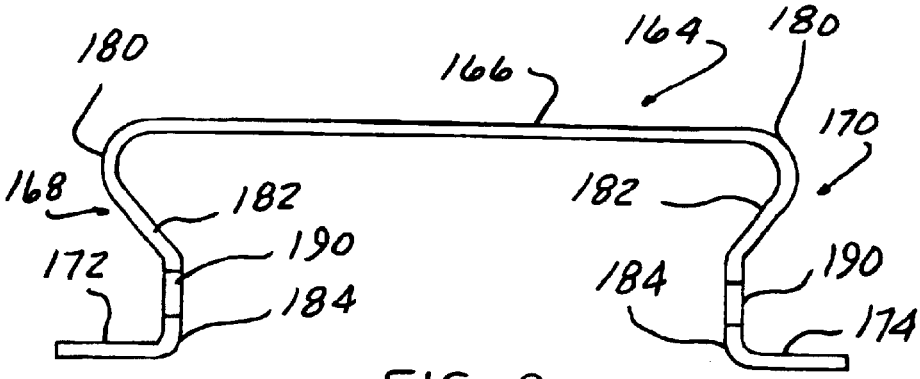
FIG. 8 is an enlarged side elevational view of the handle of the cleaning apparatus shown in FIG. 7.
Figure 9:
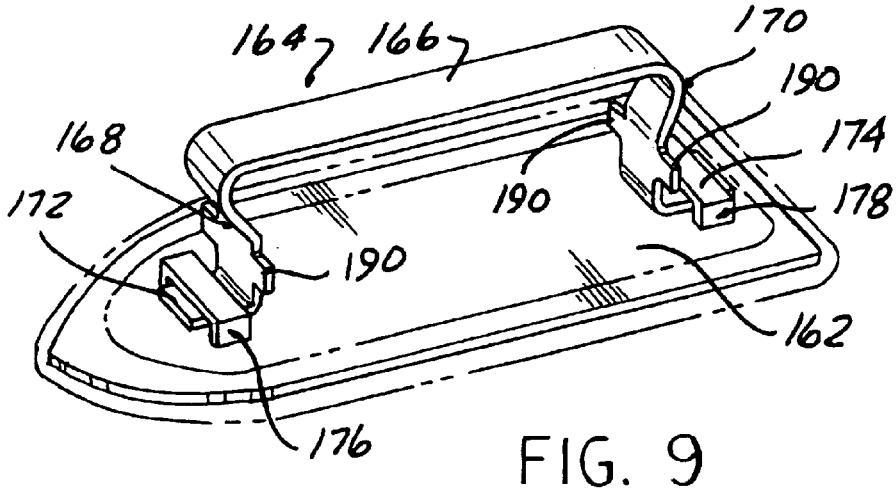
FIG. 9 is a perspective view of the assembled cleaning apparatus shown in FIGS. 7 and 8.

Referring now to FIGS. 7–9, there is depicted another aspect of the present cleaning apparatus which may form part of an overall cleaning system constructed in accordance with the present invention. As shown in FIGS. 7, 8, and 9, the cleaning apparatus 160 includes a paddle 162 which is depicted as having the same overall shape as the paddle 34 shown in FIG. 6A. It will be understood that the paddle 162 is shown by example only as any of the preceding paddles may be employed in the cleaning apparatus 160. In addition, the cleaning elements 16, described above, may also be employed over the paddle 162.

In this aspect, the cleaning apparatus 160 includes a handle 164 having a generally inverted U-shape. The handle 164 is preferably formed of a flexible plastic.

The handle 164 has a strip-like form including an upper portion in the form of a generally planar top wall 166 which is adapted to be grasped by the hand of the user to manipulate the cleaning apparatus 160 over a surface to be cleaned, a pair of depending side legs 168 and 170 and a pair of outwardly extending lower ends 172 and 174 which project outwardly from the side legs 168 and 170, respectively. The ends 172 and 174 are flat or planar in shape and are adapted to releasably engage a pair of receivers 176 and 178 formed on one surface of the paddle 162. The receivers 176 and 178 are aligned with each other, preferably along the longitudinal centerline of the paddle 162. By way of example only, each receiver 176 and 178 is formed of an inverted U-shaped tab having a central portion spaced from the adjoining surface of the paddle 162 to form an aperture there between sized to releasably receive one of the lower ends 172 and 174 of the handle 164.

The side legs 168 and 170 of the handle 164 have a smoothly curved, arcuate, S-shape to provide a degree of springiness to the handle 164. In the exemplified shape, each of the side legs 168 and 170 initially curves outward from one end of the top wall 166 of the handle 164 in a first curved portion 180 before curving inward toward the opposed side leg along portion 182. The side legs 168 and 170 then reverse direction and smoothly curve along portion 184 to a junction with the lower ends 172 and 174, respectively.

For added strength, the portions 180 and 184 have a greater thickness than the adjoining top wall 166, surface portion 182 or the lower ends 172 and 174 as the portions 180 and 184 will encounter the greatest amount of flexure during movement of the cleaning apparatus 160.

Optional, elongated, laterally extending tabs 190 project outward from opposed side edges of the surface 184 on each side leg 168 and 170. The tabs 190 provide a convenient surface for inserting and removing the lower ends 172 and 174 from the receivers 176 and 178, respectively.

Figure 10:
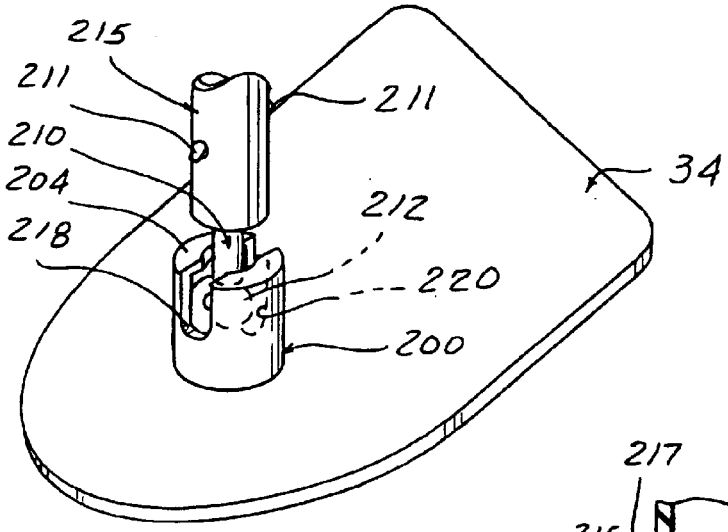
FIG. 10 is a perspective view of another aspect of the present cleaning apparatus.
Figure 11:
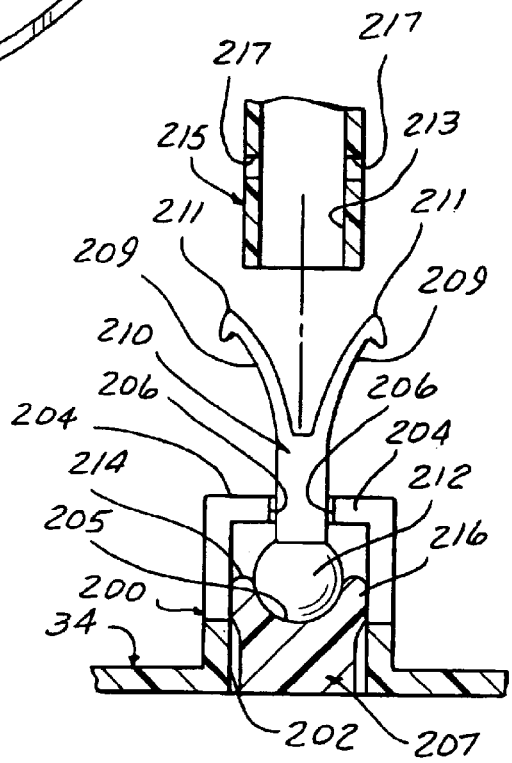
FIG. 11 is an exploded, longitudinal cross-sectional view of the cleaning apparatus shown in FIG. 10.

Referring now to FIGS. 10 and 11, there is depicted another aspect of a cleaning apparatus and system of the present invention in which the cleaning apparatus is provided with a different receiver or pivot means for pivotally attaching a handle to the plate 34.

In this aspect of the invention, the pivot means includes a generally tubular receiver 200 which is mounted on or integrally formed with the plate 34. A first end 202 of the receiver 200 is open through the bottom surface of the plate 34 as shown in FIG. 11. The other end of the receiver 200 has an end wall 204 formed with an aperture 206 having a smaller diameter than the first diameter of the first end aperture.

A handle connector 210, which may alternately form an integral extension of one end of an elongated main handle, is preferably formed with a ball or spherical shaped end 212. The diameter of the ball 212 is chosen to be slightly larger than second opening 206 in the end wall 204 of the receiver 200 such that the peripheral edges of the end wall 204 surrounding the aperture 206 act as a seat trapping the ball 212 in the receiver 200.

The coupler 210 has a pair of spaced spring arms 209 extending from one end, each including an enlargement 211 at an outer end. The arms 209 bend inward upon insertion into a bore 213 in one end of a main handle 215. The enlargements 211 resiliently snap into apertures 217 in the handle 215 to lock the coupler 210 to the main handle 215. Depression of the enlargements 211 unlocks the coupler 210 from the main handle 215.

The first open end 202 of the receiver 200 is closed by means of a plug 212 having an arcuate seat 213 at one end. The plug 212 may be adhesively secured in the receiver 200 or latched in the receiver 200 by means of a pair of spring arms 214 and 216 integrally formed with the plug 212 which lock the plug 212 in the interior of the receiver 200 in a press fit. As shown in FIG. 11, the upper ends of the arms 214 and 216 are an engagement with the ball 212 and act as a portion of the seat for the ball 212.

Although the second opening 206 could be sized to permit full 360° movement of the handle connector 210 relative to the receiver 200, in a preferred aspect of the invention, a pair of opposed slots 218 and 220 are formed in the receiver 200 extending from the second end 204 as shown in FIGS. 10 and 11. The slots 218 and 220 permit the end portion of the handle connector 210 to only pivot relative to the receiver 200 along one axis, generally aligned with the longitudinal center line of the plate 34.

Figure 12:
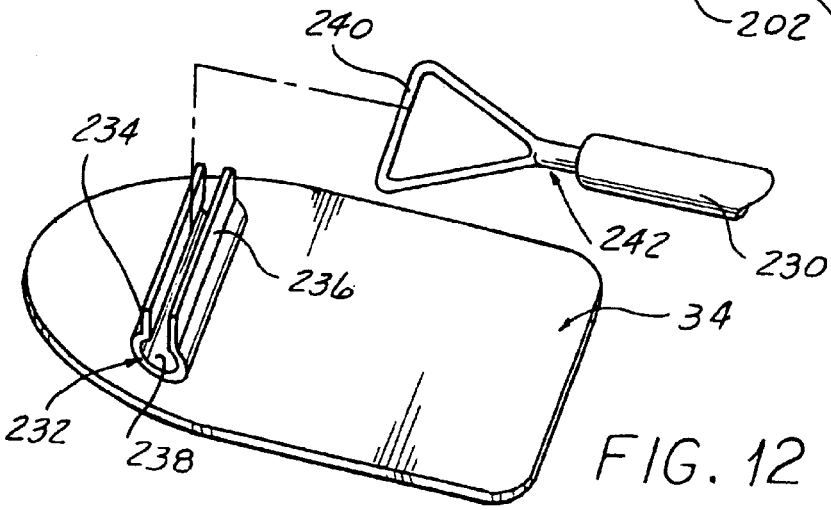
FIG. 12 is an exploded, perspective view of yet another aspect of the cleaning apparatus and system of the present invention.

FIG. 12 depicts yet another aspect of the present invention in which a different handle assembly 230 is pivotally connected to the plate 34. In this aspect of the invention, the pivot means 232 is in the form a generally U-shaped receiver having a pair of spaced ends 234 and 236 which project away from one surface of the plate 34. The ends 234 and 236 are spaced apart at a first distance. The ends 234 and 236 also open to a larger width or diameter cavity 238 which is sized to rotatably receive a cylindrical end or rod portion 240 of a handle connector 242 which is mounted in one end of the handle 230 or is formed as an integral extension of the one end of the handle 230.

In use, the end portion 240 of the handle connector 242 is forcibly urged through the spaced ends 234 and 236 until it snaps into the larger diameter recess 238 in which the rod portion 240 is freely rotatable allowing the handle 230 to pivot about the axis of the recess 238 and the rod portion 240. When it desired to replace a plate 34 or to attach a different handle to the plate 34, the rod portion 240 of the handle 230 is forcibly urged through the spaced ends 234 and 236 of the receiver 232 to disengage the handle 230 from the plate 34.

Figure 13:
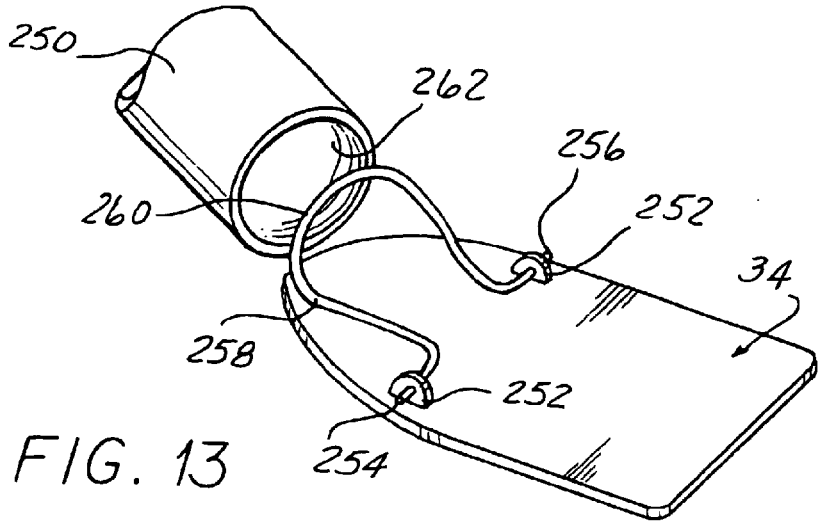
FIG. 13 is a partial perspective view of yet another aspect of the present cleaning apparatus shown in an assembled position.

FIG. 13 depicts yet another aspect of the present cleaning apparatus and system in which a different pivot means is provided for pivotally and releasably attaching a handle 250 to the plate 34. In this aspect of the invention, the pivot means includes a pair of legs 252 which are mounted on or integrally extend from one surface of the plate 34. An aperture in each leg 252 receives a bent end 254 or 256 of a generally U-shaped, resilient connector 258. The connector 258 may be formed of spring metal or a flexible plastic.

As shown in FIG. 13, a central end portion 260 of the connector 258 has a larger nominal width than the inner dimension between the outward extending ends 254 and 256. The resilient nature of the connector 258 enables the connector 258 to be forcibly slid into an open end of a bore 262 in the handle 250 and be retained within the handle 250 in a press fit wherein the spring-like nature of the connector 258 forces the central end portion outward into tight, non-moveable engagement with the inner surface of the handle 250. However, sufficient axial force can be exerted at any time to separate the handle 250 from the connector 258 to attach a different handle 250 to the plate 34 or to attach a different plate 34 to the handle 250. Also, the bent ends 254 and 256 of the connector 258 can be urged inward toward each other and out of the apertures in the legs 252 to separate the handle 250 and connector 258 from plate 34.

Figure 14:
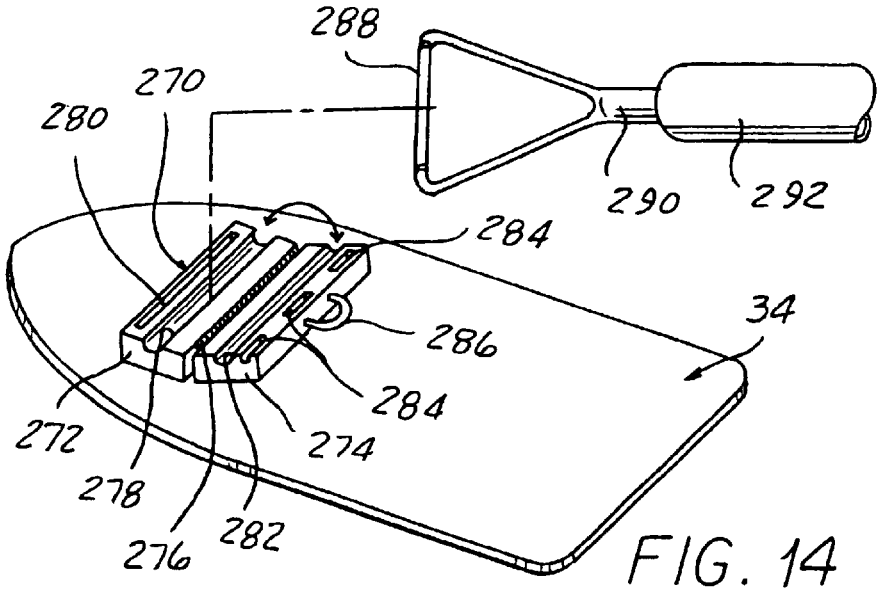
FIG. 14 is an exploded, perspective view of yet another aspect of the present cleaning apparatus and system.
Figure 15:
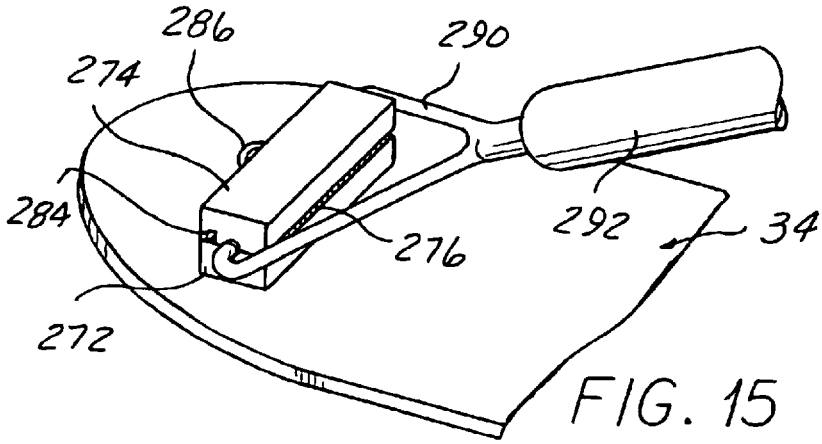
FIG. 15 is a perspective view showing the cleaning apparatus of FIG. 14 in an assembled, use position.

Another aspect of the present invention shown in FIGS. 14 and 15 utilizes a receiving means 270 fixedly mounted on the plate 34 which includes a releasable latch. In this aspect of the invention, the receiver means 270 is in the form of a two part housing formed of a base portion 272 fixedly or integrally carried on one surface of the plate 34 and a second moveable portion 274 which is hingedly attached to the hinge 276 to the base 272 for pivotal movement from a first open position shown in FIG. 14 to a second closed position shown in FIG. 15. The moveable member 274 may be completely separate from the base 272 or integrally coupled thereto by means of a living hinge.

In one aspect shown in FIGS. 14 and 15, the latch is a magnetically operable latch. An open ended recess 278 is formed laterally in the base 272. A metallic member 280 in the form of a strip is mounted in the base 272 generally adjacent to the recess 278. A mating semicircular recess 282 is formed in the moveable member 274. When the moveable member 274 is in the second closed position shown in FIG. 15, the recess 282 forms a generally circular cross section bore in combination with the recess 278 through the juxtaposed base 272 and moveable member 274.

A single magnet or, a plurality of small magnet elements 284 are mounted in the moveable member 274 adjacent to the recess 282. The magnets 284 are magnetically attracted to the metallic member 280 in the base 272 to forcibly latch the moveable member 274 in the second closed position shown in FIG. 15. However, a pivotal force exerted on a handle or projection 286 extending outward from one edge of the moveable member 274 is sufficient to move the moveable member 274 to the first open position.

When the receiver 270 is in the open position shown in FIG. 14, a cylindrical rod 288 at one end of a handle connector 290 fixedly attached to a handle 292 or formed as an integral extension of one end of the handle 292 may be rotatably mounted in the recess 278. The latching of the moveable member 274 in the closed position shown in FIG. 15 traps the rod 288 in the recesses 278 and 282 while allowing the handle connector 290 and the handle 292 to pivot about an axis extending through the center of the rod 288.

Alternately, the latch can be a clip-type latch including a projection on one of the base members 272 or 274 which is releasably engagable in a snap fit in an aperture in the other base member 274 or 272.

Thus, there has been disclosed a unique cleaning system for cleaning and drying various surfaces, such as the interior surfaces of windows and, particularly, vehicle windows, which is easy to use, is capable of providing scrubbing and drying, has easily detachably mounted paddles, and scrubbing and drying elements enabling different shaped paddles and fresh, dry cleaning elements to be easily attached to the handle for scrubbing and drying various portions of different shaped windows as well as enabling the cleaning elements to be easily removed when wet or soiled and replaced with a new element.

What is claimed is:

1. A cleaning apparatus comprising:

a paddle;

a receiver carried on the paddle;

a cleaning element removably affixed to the paddle; and a handle having a first end pivotally mountable in the receiver, the handle having a second user engagable end;

the receiver including:

a base fixed to the paddle;

a moveable portion hingedly connected to the base and moveable between a first closed position overlaying the base and a first open position spaced from the base;

complementary recesses formed in the base and the moveable portion, the recesses defining a bore when the moveable member is in the first closed position for pivotally receiving the first end of the handle; and means for latching the moveable portion in the first closed position to the base.

2. The cleaning apparatus of claim 1 wherein:

the cleaning element is formed of a rough textured material to form a scrubbing surface.

3. The cleaning apparatus of claim 1 wherein the latching means comprises:

a magnet formed in one of the base and the moveable portion; and a metallic member in the other of the base and the moveable portion.

4. The cleaning apparatus of claim 1 further comprising:

a projection on the moveable portion facilitating movement of the moveable portion between the first and second positions.

5. The cleaning apparatus of claim 1 wherein:

the paddle is one of a plurality of interchangeably useable paddles each carrying one receiver, at least certain of the paddles having a different shape;

the cleaning element is one of a plurality of cleaning elements, each removably attachable one at a time to one of the paddles, each of the cleaning elements having elastic means forming side edges of the cleaning element into a closed opening, nominally smaller than the outer peripheral surface dimensions of each of the paddles; and whereby the handle, one of the plurality of paddles, and one of the cleaning elements are releasably engagable to form a cleaning apparatus for cleaning a surface.

* * * * *